US009858932B2

(12) United States Patent
Arnott et al.

(10) Patent No.: US 9,858,932 B2
(45) Date of Patent: Jan. 2, 2018

(54) PROCESSING OF TIME-VARYING METADATA FOR LOSSLESS RESAMPLING

(71) Applicants: Dolby Laboratories Licensing Corporation, San Francisco, CA (US); DOLBY INTERNATIONAL AB, Amsterdam Zuidoost (NL)

(72) Inventors: Brian George Arnott, Wahroonga (AU); Dirk Jeroen Breebaart, Pyrmont (AU); Antonio Mateos Sole, Barcelona (ES); David S. McGrath, Rose Bay (AU); Heiko Purnhagen, Sundbyberg (SE); Freddie Sanchez, Berkeley, CA (US); Nicolas R. Tsingos, Palo Alto, CA (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 14/903,508

(22) PCT Filed: Jul. 1, 2014

(86) PCT No.: PCT/US2014/045156
§ 371 (c)(1),
(2) Date: Jan. 7, 2016

(87) PCT Pub. No.: WO2015/006112
PCT Pub. Date: Jan. 15, 2015

(65) Prior Publication Data

US 2016/0163321 A1 Jun. 9, 2016

Related U.S. Application Data

(60) Provisional application No. 61/875,467, filed on Sep. 9, 2013.

(30) Foreign Application Priority Data

Jul. 8, 2013 (ES) ..... 201331022

(51) Int. Cl.
*G10L 21/00* (2013.01)
*G10L 13/00* (2006.01)
(Continued)

(52) U.S. Cl.
CPC ..... *G10L 19/0017* (2013.01); *G10L 19/005* (2013.01); *G10L 19/008* (2013.01); *G10L 19/167* (2013.01); *G10L 19/24* (2013.01)

(58) Field of Classification Search
CPC . G10L 19/167; G10L 19/0017; G10L 19/173; H04S 2400/11; H04S 7/30;
(Continued)

(56) References Cited

U.S. PATENT DOCUMENTS 7,424,117 B2 9/2008 Herberger
8,139,930 B2 3/2012 Ogawa
(Continued)

FOREIGN PATENT DOCUMENTS

RS 1332 U 8/2013
WO 2005/089360 9/2005
(Continued)

OTHER PUBLICATIONS

Chung et al, "Sound reproduction method by front loudspeaker array for home theater applications," May 2012, in IEEE Transactions on Consumer Electronics, vol. 58, No. 2, pp. 528-534, May 2012.*
(Continued)

*Primary Examiner* — Olujimi Adesanya

(57) ABSTRACT

Embodiments are directed to a method of representing spatial rendering metadata for processing in an object-based
(Continued)

audio system that allows for lossless interpolation and/or re-sampling of the metadata. The method comprises time stamping the metadata to create metadata instances, and encoding an interpolation duration to with each metadata instance that specifies the time to reach a desired rendering state for the respective metadata instance. The re-sampling of metadata is useful for re-clocking metadata to an audio coder and for the editing audio content.

16 Claims, 5 Drawing Sheets

(51) Int. Cl.

| | |
|---|---|
| ***G10L 19/00*** | (2013.01) |
| ***G10L 19/008*** | (2013.01) |
| ***G10L 19/16*** | (2013.01) |
| ***G10L 19/005*** | (2013.01) |
| ***G10L 19/24*** | (2013.01) |

(58) Field of Classification Search
CPC ..... H04S 2400/03; H04S 7/00; H04S 3/02; H04S 2400/01; H04S 7/302; H04R 5/02
USPC ..... 704/500–504
See application file for complete search history.

(56) References Cited

U.S. PATENT DOCUMENTS

| | | | | |
|---|---|---|---|---|
| 8,380,333 | B2 | 2/2013 | Ojala | |
| 2006/0020207 | A1* | 1/2006 | Pagoulatos | G01S 15/8993 600/456 |
| 2008/0114606 | A1* | 5/2008 | Ojala | G10L 19/008 704/500 |
| 2009/0046864 | A1 | 2/2009 | Mahabub | |
| 2010/0080382 | A1* | 4/2010 | Dresher | H04M 1/6033 379/421 |
| 2010/0083344 | A1* | 4/2010 | Schildbach | H03G 7/007 725/151 |
| 2010/0215195 | A1 | 8/2010 | Harma | |
| 2011/0004479 | A1* | 1/2011 | Ekstrand | G10L 19/022 704/500 |
| 2012/0170756 | A1 | 7/2012 | Kraemer | |
| 2012/0183162 | A1* | 7/2012 | Chabanne | H04N 5/642 381/306 |
| 2012/0213375 | A1 | 8/2012 | Mahabub | |
| 2012/0230497 | A1 | 9/2012 | Dressler | |
| 2012/0328109 | A1 | 12/2012 | Harma | |
| 2013/0096930 | A1 | 4/2013 | Neuendorf | |
| 2013/0132098 | A1 | 5/2013 | Beack | |
| 2014/0297291 | A1* | 10/2014 | Baumgarte | G10L 19/008 704/500 |
| 2015/0279378 | A1* | 10/2015 | Craven | G10L 19/018 704/500 |
| 2016/0104496 | A1* | 4/2016 | Purnhagen | G10L 19/008 381/22 |
| 2016/0111099 | A1* | 4/2016 | Hirvonen | G10L 19/20 381/22 |

FOREIGN PATENT DOCUMENTS

| | | |
|---|---|---|
| WO | 2007/083952 | 7/2007 |
| WO | 2011/119401 | 9/2011 |
| WO | 2013/006338 | 1/2013 |

OTHER PUBLICATIONS

Jain, Rajest Kumar "A/D and D/A Converters" in Principles of Synchronous Digital Hierarchy, Jul. 19, 2012 Taylor and Francis, pp. 58-60.

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.

Stanojevic, T. et al "Designing of TSS Halls" 13th International Congress on Acoustics, Yugoslavia, 1989.

Stanojevic, T. et al "The Total Surround Sound (TSS) Processor" SMPTE Journal, Nov. 1994.

Stanojevic, T. et al "The Total Surround Sound System", 86th AES Convention, Hamburg, Mar. 7-10, 1989.

Stanojevic, T. et al "TSS System and Live Performance Sound" 88th AES Convention, Montreux, Mar. 13-16, 1990.

Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.

Stanojevic, Tomislav "3-D Sound in Future HDTV Projection Systems" presented at the 132nd SMPTE Technical conference, Jacob K. Javits Convention Center, New York City, Oct. 13-17, 1990.

Stanojevic, Tomislav "Surround Sound for a New Generation of Theaters, Sound and Video Contractor" Dec. 20, 1995.

Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

* cited by examiner

200

| METADATA TYPE (202) | METADATA ELEMENTS (204) |
|---|---|
| POSITION | Coordinate Value |
| WIDTH | Scalar Value |
| CONTENT TYPE/ COMBINED CONTENT TYPE | Probability Measure: Dialog/music/ambient/effects |
| LOUDNESS/ PARTIAL LOUDNESS/ COMBINED LOUDNESS | Energy or dB value |
| RENDERING MODES | Integer Value Mode 1, Mode 2, etc. |
| CONTROL SIGNALS | Driver Assignments Fixed Channel/Mobile Object |

$m_X$

PROCESSING OF TIME-VARYING METADATA FOR LOSSLESS RESAMPLING

CROSS-REFERENCE TO RELATED APPLICATIONS

This application claims the benefit of priority to Spanish Patent Application No. P201331022 filed 8 Jul. 2013 and U.S. Provisional Patent Application No. 61/875,467 filed 9 Sep. 2013, each of which is hereby incorporated by reference in its entirety

TECHNICAL FIELD

One or more implementations relate generally to audio signal processing, and more specifically to lossless resampling schemes for processing and rendering of audio objects based on spatial rendering metadata.

BACKGROUND

The advent of object-based audio has significantly increased the amount of audio data and the complexity of rendering this data within high-end playback systems. For example, cinema sound tracks may comprise many different sound elements corresponding to images on the screen, dialog, noises, and sound effects that emanate from different places on the screen and combine with background music and ambient effects to create the overall auditory experience. Accurate playback requires that sounds be reproduced in a way that corresponds as closely as possible to what is shown on screen with respect to sound source position, intensity, movement, and depth. Object-based audio represents a significant improvement over traditional channel-based audio systems that send audio content in the form of speaker feeds to individual speakers in a listening environment, and are thus relatively limited with respect to spatial playback of specific audio objects.

The introduction of digital cinema and the development of three-dimensional ("3D") content has created new standards for sound, such as the incorporation of multiple channels of audio to allow for greater creativity for content creators, and a more enveloping and realistic auditory experience for audiences. Expanding beyond traditional speaker feeds and channel-based audio as a means for distributing spatial audio is critical, and there has been considerable interest in a model-based audio description that allows the listener to select a desired playback configuration with the audio rendered specifically for their chosen configuration. The spatial presentation of sound utilizes audio objects, which are audio signals with associated parametric source descriptions of apparent source position (e.g., 3D coordinates), apparent source width, and other parameters. Further advancements include a next generation spatial audio (also referred to as "adaptive audio") format that comprises a mix of audio objects and traditional channel-based speaker feeds (beds) along with positional metadata for the audio objects.

New professional and consumer-level cinema systems (such as the Dolby® Atmos™ system) have been developed to further the concept of hybrid audio authoring, which is a distribution and playback format that includes both audio beds (channels) and audio objects. Audio beds refer to audio channels that are meant to be reproduced in predefined, fixed speaker locations while audio objects refer to individual audio elements that may exist for a defined duration in time but also have spatial information describing the position, velocity, and size (as examples) of each object. During transmission beds and objects can be sent separately and then used by a spatial reproduction system to recreate the artistic intent using a variable number of speakers in known physical locations. In some soundtracks, there may be up to 7, 9 or even 11 bed channels containing audio. Additionally, based on the capabilities of an authoring system there may be tens or even hundreds of individual audio objects that are combined during rendering to create a spatially diverse and immersive audio experience.

FIG. 1A illustrates the combination of channel and object-based data to produce an adaptive audio mix, under an embodiment. As shown in process 100, the channel-based data 102, which, for example, may be 5.1 or 7.1 surround sound data provided in the form of pulse-code modulated (PCM) data is combined with audio object data 104 to produce an adaptive audio mix 108. The audio object data 104 is produced by combining the elements of the original channel-based data with associated metadata that specifies certain parameters pertaining to the location of the audio objects. As shown conceptually in FIG. 1A, the authoring tools provide the ability to create audio programs that contain a combination of speaker channel groups and object channels simultaneously. For example, an audio program could contain one or more speaker channels optionally organized into groups (or tracks, e.g., a stereo or 5.1 track), descriptive metadata for one or more speaker channels, one or more object channels, and descriptive metadata for one or more object channels.

The large number of audio signals present in object-based content poses new challenges for the rendering of such content. Each object requires a rendering process, which determines how the object signal should be distributed over the available reproduction channels. For example, in a loudspeaker reproduction system consisting of a 5.1 setup with left front, right front, center, low-frequency effects, left surround, right surround channels, an object may be reproduced by any subset of these loudspeakers, depending on their spatial information. The (relative) level of each loudspeaker greatly influences the perceived position by the listener. In practical systems, a panning law or panning system is used to determine the so-called panning gains or relative level of each loudspeaker to result in a perceived object location that closely resembles the intended object location as indicated by its spatial information or metadata. If multiple objects are to be distributed over several loudspeakers, the process of panning can be represented by a panning or rendering matrix, which determines the gain (or signal proportion) of each object to each loudspeaker. In practical cases, such rendering matrix will be time varying to allow for variable object positions.

Besides position metadata, other, more advanced metadata may be associated with objects as well. For example, a speaker mask may be included in an object's metadata, which indicates a subset of loudspeakers that should be used for rendering. Alternatively, certain loudspeakers may be excluded for rendering an object. For example, an object may be associated with a speaker mask that excludes the surround channels or ceiling channels for rendering that object. Alternatively, or additionally, an object may have metadata that signal the rendering of an object by a speaker array rather than a single speaker or pair of loudspeakers. For practical and efficiency reasons, such metadata are often of binary nature (e.g., a certain loudspeaker is, or is not used to render a certain object). In practical systems, the use of such advanced metadata influences the coefficients present in the rendering matrix.

In object-based audio systems, object metadata is typically updated relatively infrequently (sparsely) in time to limit the associated data rate. Typical update intervals for object positions can range between 10 and 500 milliseconds, depending on the speed of the object, the required position accuracy, the available bandwidth to store or transmit metadata, and so on. Such sparse, or even irregular metadata updates require interpolation of metadata and/or rendering matrices for audio samples in-between two subsequent metadata instances. Without interpolation, the consequential step-wise changes in the rendering matrix may cause undesirable switching artifacts, clicking sounds, zipper noises, or other undesirable artifacts as a result of spectral splatter introduced by step-wise matrix updates.

FIG. 1B illustrates a typical known process to compute a rendering matrix for a set of metadata instances. As shown in FIG. 1B, a set of metadata instances (m1 to m4) 120 correspond to a set of time instances (t1 to t4) which are indicated by their position along the time axis 124. Subsequently, each metadata instance is converted to a respective rendering matrix (c1 to c4) 122, or a complete rendering matrix that is valid at that same time instance. Thus, as shown, metadata instance m1 creates rendering matrix c1 at time t1, metadata instance m2 creates rendering matrix c2 at time t2, and so on. For simplicity, FIG. 1B shows only one rendering matrix for each metadata instance m1 to m4. In practical systems, however, a rendering matrix may comprise a set of rendering matrix coefficients or gain coefficients $c_{1,i,j}$ to be applied to object signal with index j to create output signal with index i:

$$y_j(t) = \sum_i x_i(t) c_{1,i,j}$$

In the above equation $x_i(t)$ represents the signal of object i, and $y_i(t)$ represents output signal with index j.

The rendering matrices generally comprise coefficients that represent gain values at different instances in time. Metadata instances are defined at certain discrete times, and for audio samples in-between the metadata time stamps, the rendering matrix is interpolated, as indicated by the dashed line 126 connecting the rendering matrices 122. Such interpolation can be performed linearly, but also other interpolation methods can be used (such as band-limited interpolation, sine/cosine interpolation, and so on). The time interval between the metadata instances (and corresponding rendering matrices) is referred to as an "interpolation duration," and such intervals may be uniform or they may be different, such as the longer interpolation duration between times t3 and t4 as compared to the interpolation duration between times t2 and t3.

In general, present metadata update and interpolation systems are sufficient for relatively simple objects in which the metadata definitions dictate object position and/or gain values for speakers. The change of such values can usually be adequately be interpolated in present systems by interpolation of metadata instances. For complex objects and cases in which the metadata instances are limited to certain possible values, present interpolation methods operating on metadata directly are typically unsatisfactory. For example, if a metadata instance is limited to one of two values (binary metadata), standard interpolation techniques would derive the incorrect value about half the time.

In many cases, the calculation of rendering matrix coefficients from metadata instances is well defined, but the reverse process of calculating metadata instances given a (interpolated) rendering matrix, is often difficult, or even impossible. In this respect, the process of generating a rendering matrix from metadata can sometimes be regarded as a cryptographic one-way function. The process of calculating new metadata instances between existing metadata instances is referred to as "resampling" of the metadata. Resampling of metadata is often required during certain audio processing tasks. For example, when audio content is edited, by cutting/merging/mixing and so on, such edits may occur in between metadata instances. In this case, resampling of the metadata is required. Another such case is when audio and associated metadata are encoded with a frame-based audio coder. In this case, it is desirable to have at least one metadata instance for each audio codec frame, preferably with a time stamp at the start of that codec frame, to improve resilience of frame losses during transmission. As stated above, interpolation of metadata is also ineffective for certain types of metadata, such as binary-valued metadata. For example, if binary flags such as zone exclusion masks are used, it is virtually impossible to estimate a valid set of metadata from the rendering matrix coefficients or from neighboring instances of metadata. This is shown in FIG. 1B as a failed attempt to extrapolate or derive a metadata instance m3*a* from the rendering matrix coefficients in the interpolation duration between times t3 and t4.

Thus, in present metadata processing for adaptive audio, any metadata resampling or upsampling process by means of interpolation is practically impossible without introducing inaccuracies in the resulting rendering matrix coefficients, and hence a loss in spatial audio quality.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF EMBODIMENTS

Some embodiments are directed to a method for representing time-varying rendering metadata in an object-based audio system, where the metadata specifies a desired rendering state that is derived from a metadata instance, by defining a time stamp indicating a point in time to begin a transition from a current rendering state to the desired rendering state, and specifying, in the metadata, an interpolation duration parameter indicating the required time to reach the desired rendering state. In this method, the desired rendering state represents one of: a spatial rendering vector or rendering matrix, and the metadata may describe the spatial rendering data of one or more audio objects. The metadata may comprise a plurality of metadata instances that are converted to respective rendering states specifying gain factors for playback of the audio content through audio drivers in a playback system.

In an embodiment, the metadata describes how an object should be rendered through the playback system. The metadata may include one or more of the object attributes comprising one of object position, object size, or object zone exclusion. The method may further comprise generating one or more additional metadata instances that are substantially similar to a previous or subsequent metadata instance across time, with the exception of the interpolation duration parameter.

In an embodiment, the spatial rendering vector or rendering matrix is interpolated across time. The method may utilize one of a linear or non-linear interpolation method. The interpolation method may comprise performing a sample-and-hold operation to generate a step-wise interpolation curve, and applying a low-pass filter process to the step-wise interpolation curve to generate a smooth interpolation curve.

In an embodiment, the time stamp represents the start of the transition from a current to a desired rendering state. The time stamp may be defined relative to a reference point in audio content processed by the object-based audio system. In another implementation, the time stamp represents the end point of a transition from a current to a desired rendering state.

The method may further comprise determining if a change between the current state does not significantly deviate from the desired state, and removing one or more metadata instances in between the current state and the desired state if the change does not significantly deviate.

Embodiments are further directed to a method for processing object-based audio by defining a plurality of metadata instances specifying a desired rendering state of audio objects within a portion of audio content, each metadata instance associated with a unique time stamp, and encoding each metadata instance with an interpolation duration specifying a future time that the change from a first rendering state to a second rendering state should be completed. The method may further comprise converting each metadata instance into a set of values defining one of a spatial rendering vector or rendering matrix defining the second rendering state. In this method, each metadata instance describes spatial rendering data of one or more of the audio objects, and the set of values comprise gain factors for playback of the one or more audio objects through audio drivers in a playback system.

Some further embodiments are described for systems or devices that implement the embodiments for the method of compressing or the method of rendering described above, and to products of manufacture that store instructions that execute the described methods in a processor-based computing system.

The methods and systems described herein may be implemented in an audio format and system that includes updated content creation tools, distribution methods and an enhanced user experience based on an adaptive audio system that includes new speaker and channel configurations, as well as a new spatial description format made possible by a suite of advanced content creation tools. In such a system, audio streams (generally including channels and objects) are transmitted along with metadata that describes the content creator's or sound mixer's intent, including desired position of the audio stream. The position can be expressed as a named channel (from within the predefined channel configuration) or as three-dimensional (3D) spatial position information.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Figure 1A:
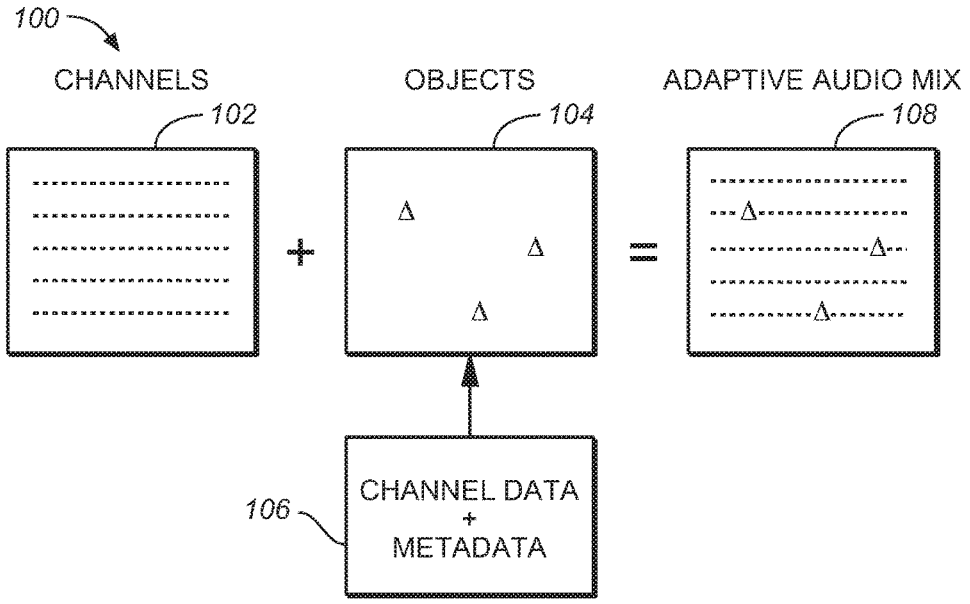
FIG. 1A (PRIOR ART)
FIG. 1A illustrates the combination of channel and object-based data to produce an adaptive audio mix, under an embodiment.

Systems and methods are described for an improved metadata resampling scheme for object-based audio data and processing systems. Aspects of the one or more embodiments described herein may be implemented in an audio or audio-visual (AV) system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" or "bed" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on; the term "object" or "object-based audio" means one or more audio channels with a parametric source description, such as apparent source position (e.g., 3D coordinates), apparent source width, etc.; "adaptive audio" means channel-based and/or object-based audio signals plus metadata that renders the audio signals based on the playback environment using an audio stream plus metadata in which the position is coded as a 3D position in space; and "rendering" means conversion to, and possible storage of, digital signals that may eventually be converted to electrical signals used as speaker feeds. Embodiments described herein apply to beds and objects, as well as other scene-based audio content, such as Ambisonics-based content and systems; thus, such embodiments may apply to situations where object-based audio is combined with other non-object and non-channel based content, such as Ambisonics audio, or other similar scene-based audio.

In an embodiment, the spatial metadata resampling scheme is implemented as part of an audio system that is configured to work with a sound format and processing system that may be referred to as a "spatial audio system" or "adaptive audio system." Such a system is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio elements and audio object coding elements. Such a combined approach provides greater coding efficiency and rendering flexibility compared to either channel-based or object-based approaches taken separately. An example of an adaptive audio system that may be used in conjunction with present embodiments is described in PCT application publication WO2013/006338 published on Jan. 10, 2013 and entitled "System and Method for Adaptive Audio Signal Generation, Coding and Rendering," which is hereby incorporated by reference, and attached hereto as Appendix 1. An example implementation of an adaptive audio system and associated audio format is the Dolby® Atmos™ platform. Such a system incorporates a height (up/down) dimension that may be implemented as a 9.1 surround system, or similar surround sound configuration.

Audio objects can be considered individual or collections of sound elements that may be perceived to emanate from a particular physical location or locations in the listening environment. Such objects can be static (that is, stationary) or dynamic (that is, moving). Audio objects are controlled by metadata that defines the position of the sound at a given point in time, along with other functions. When objects are played back, they are rendered according to the positional metadata using the speakers that are present, rather than necessarily being output to a predefined physical channel. A track in a session can be an audio object, and standard panning data is analogous to positional metadata. In this way, content placed on the screen might pan in effectively the same way as with channel-based content, but content placed in the surrounds can be rendered to individual speakers, if desired. While the use of audio objects provides control over discrete effects, other aspects of a soundtrack may work more effectively in a channel-based environment. For example, many ambient effects or reverberation actually benefit from being fed to arrays of speakers rather than individual drivers. Although these could be treated as objects with sufficient width to fill an array, it is beneficial to retain some channel-based functionality.

An adaptive audio system extends beyond speaker feeds as a means for distributing spatial audio and uses advanced model-based audio descriptions to tailor playback configurations that suit individual needs and system constraints so that audio can be rendered specifically for individual configurations. The spatial effects of audio signals are critical in providing an immersive experience for the listener. Sounds that are meant to emanate from a specific region of a viewing screen or room should be played through speaker(s) located at that same relative location. Thus, the primary audio metadatum of a sound event in a model-based description is position, though other parameters such as size, orientation, velocity and acoustic dispersion can also be described.

Figure 1B:
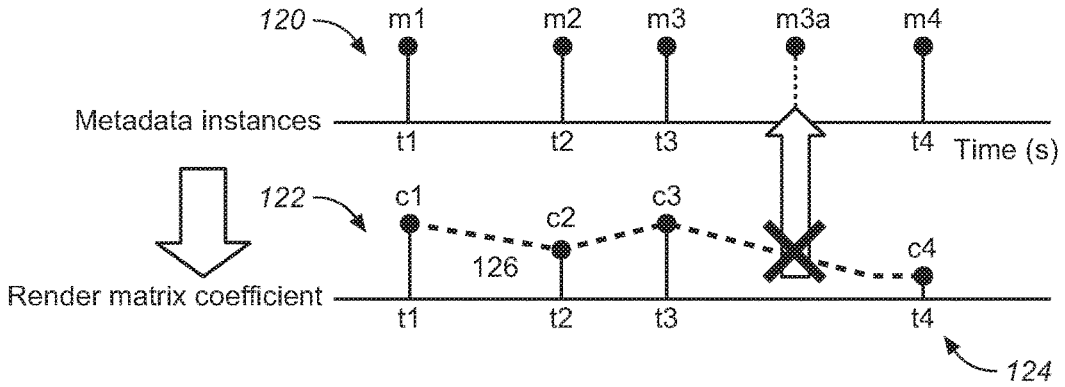
FIG. 1B (PRIOR ART)
FIG. 1B illustrates a typical known process to compute a rendering matrix for a set of metadata instances.
Figures 2A, 2B:
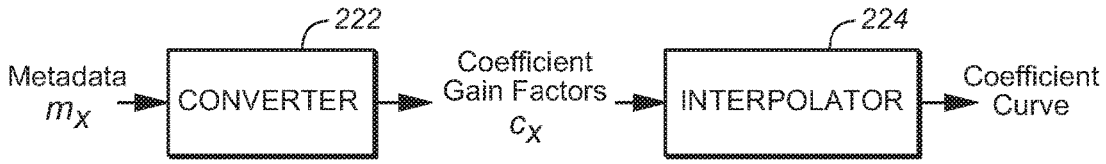
FIG. 2A is a table that illustrates example metadata definitions for defining metadata instances, under an embodiment.
FIG. 2B illustrates the derivation of a matrix coefficient curve of gain values from metadata instances, under an embodiment.

FIG. 2A is a table that illustrates example metadata definitions for defining metadata instances, under an embodiment. As shown in column 202 of table 200, the metadata definitions include metadata types such as: object position, object width, audio content type, loudness, rendering modes, control signals, among other possible metadata types. The metadata definitions include elements that define certain values associated with each metadata type. Example metadata elements for each metadata type are listed in column 204 of table 200. At any given time, an object may have various different metadata elements that comprise a metadata instance $m_x$ for a particular time $t_x$. Not all metadata elements may be represented in a particular metadata instance, but a metadata instance typically includes two or more metadata elements specifying particular spatial characteristics of the object. Each metadata instance is used to derive a respective set of matrix coefficients $c_x$, also referred to as a rendering matrix, as shown in FIG. 1B.

Table 200 of FIG. 2A is intended to list only certain example metadata elements, and it should be understood that other or different metadata definitions and elements are also possible.

FIG. 2B illustrates the derivation of a matrix coefficient curve of gain values from metadata instances, under an embodiment. As shown in FIG. 2B, a set of metadata instances $m_x$ generated at different times $t_x$ are converted by converter 222 into corresponding sets of matrix coefficient values $c_x$. These sets of coefficients represent the gain values for the various speakers and drivers in the system. An interpolator 224 then interpolates the gain factors to produce a coefficient curve between the discrete times $t_x$. In an embodiment, the time stamps $t_x$ associated with each metadata instance may be random time values, synchronous time values generated by a clock circuit, time events related to the audio content, such as frame boundaries, or any other appropriate timed event.

As shown in FIG. 1B, metadata instances $m_x$ are only definitely defined at certain discrete times $t_x$, which in turn produces the associated set of matrix coefficients $c_x$. In between these discrete times $t_x$, the sets of matrix coefficients must be interpolated based on past or future metadata instances. However, as described above, present metadata interpolation schemes suffer from loss of spatial audio quality due to unavoidable inaccuracies in metadata interpolation processes.

Figure 3:
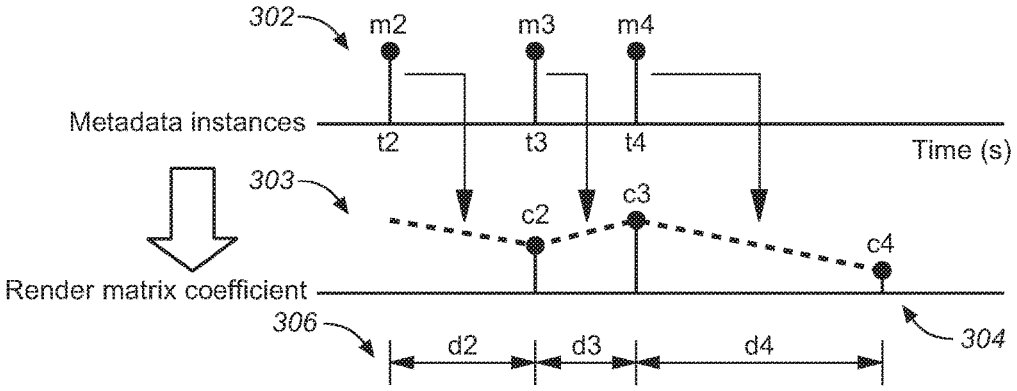
FIG. 3 illustrates a metadata instance interpolation method, under an embodiment.

FIG. 3 illustrates a metadata instance resampling method, under an embodiment. The method of FIG. 3 addresses at least some of the interpolation problems associated with present methods as described above by defining a time stamp as the start time of an interpolation duration, and augmenting each metadata instance with a parameter that represents the interpolation duration (also referred to as "ramp size"). As shown in FIG. 3, a set of metadata instances m2 to m4 (302) describes a set of rendering matrices c2 to c4 (304). Each metadata instance is generated at a particular time $t_x$, and each metadata instance is defined with respect to its time stamp, m2 to t2, m3 to t3, and so on. The associated rendering matrices 304 are generated after processing respective time spans d2, d3, d4 (306), from the associated time stamp (t1 to t4) of each metadata instance 302. The time span (or ramp size) is included with each metadata instance, i.e., metadata instance m2 includes d2, m3 includes d3, and so on. Schematically this can be represented as follows: $m_x$=(metadata($t_x$), $d_x$)→$c_x$.

In this manner, the metadata essentially provides a schematic of how to proceed from a current state (e.g., the current rendering matrix resulting from previous metadata) to a new state (e.g., the new rendering matrix resulting from the current metadata. Each metadata instance is meant to take effect at a specified point in time in the future relative to the moment the metadata instance was received and the coefficient curve is derived from the previous state of the coefficient. Thus, in FIG. 3, m2 generates c2 after a period d2, m3 generates c3 after a period d3 and m4 generates c4 after a period d4. In this scheme, for interpolation, the previous metadata need not be known, only the previous rendering matrix state is required. The interpolation may be linear or non-linear depending on system constraints and configurations.

Figure 4:
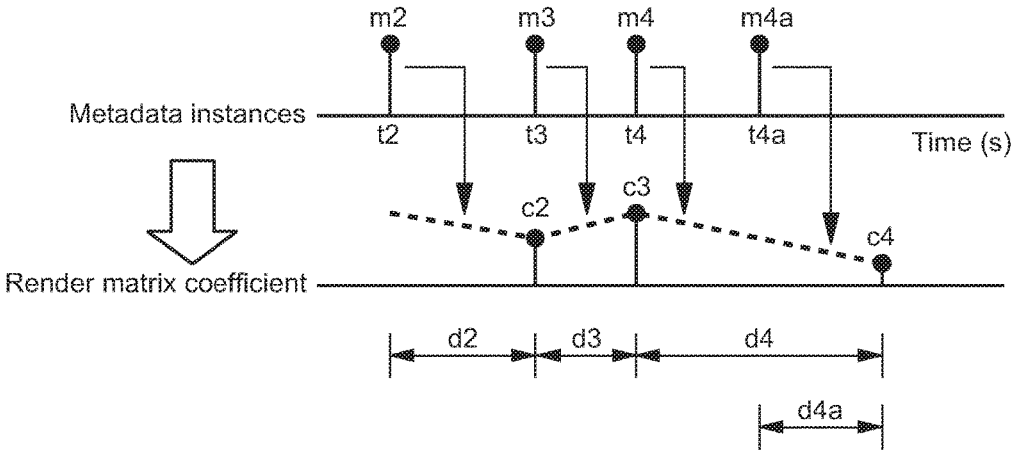
FIG. 4 illustrates a first example of lossless interpolation of metadata, under an embodiment.

The metadata resampling method of FIG. 3 allows for lossless upsampling and downsampling of metadata as shown in FIG. 4. FIG. 4 illustrates a first example of lossless processing of metadata, under an embodiment. FIG. 4 shows metadata instances m2 to m4 that refer to the future rendering matrices c2 to c4, respectively, including interpolation durations d2 to d4. The time stamps of the metadata instances m2 to m4 are given as t2 to t4. In the example of FIG. 4, a new set of metadata m4*a* at time t4*a* is added. Such metadata may be added for several reasons, such as to improve error resilience of the system or to synchronize metadata instances with the start/end of an audio frame. For example, time t4*a* may represent the time that the codec starts a new frame. For lossless operation, the metadata values of m4*a* are identical to those of m4 (as they both describe a target rendering matrix c4), but the time to reach that point has reduced d4−d4*a*. In other words, metadata instance m4*a* is identical to that of the previous m4 instance so that the interpolation curve between c3 and c4 is not changed. However, the interpolation duration d4*a*, is shorter than the original duration d4. This effectively increases the data rate of the metadata instances, which can be beneficial in certain circumstances, such as error correction.

Figure 5:
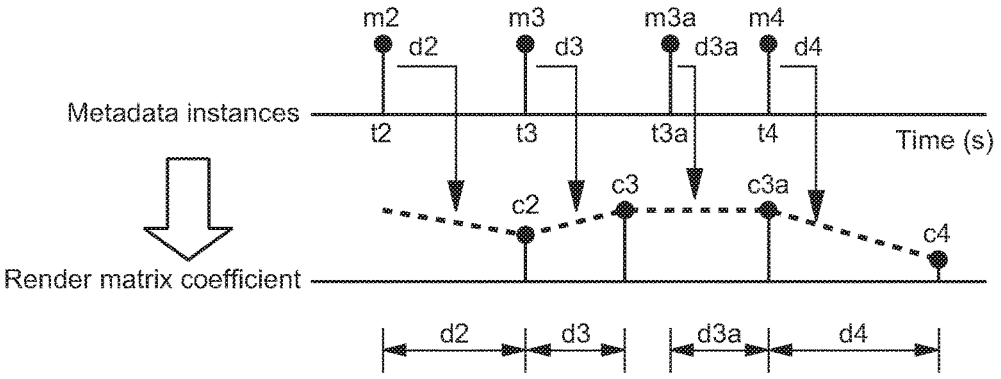
FIG. 5 illustrates a second example of lossless interpolation of metadata, under an embodiment.

A second example of lossless metadata interpolation is shown in FIG. 5. In this example, the goal is to include a new set of metadata m3*a* in between m3 and m4. FIG. 5 illustrates a case where the rendering matrix remains unchanged for a period of time. Therefore, in this situation, the values of the metadata m3*a* are identical to those of the prior m3 metadata, except for the interpolation duration d3*a*. The value of d3*a* should be set to the value corresponding to t4−t3*a*. The case of FIG. 5 may occur when an object is static and an authoring tool stops sending new metadata for the object due to this static nature. In such a case, it may be desirable to insert metadata instances such as m3*a* to synchronize with codec frames, or other similar reasons.

Figure 6:
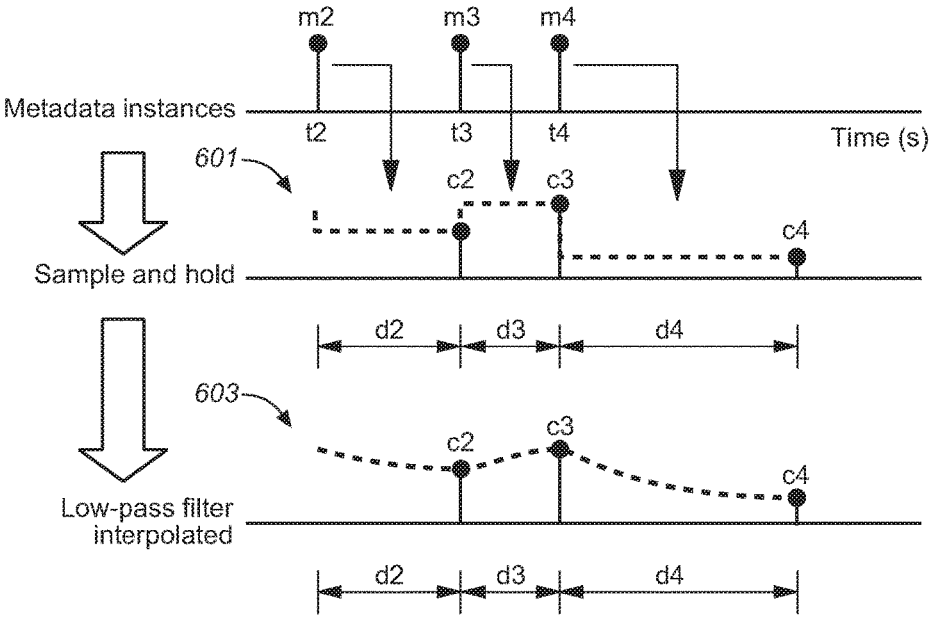
FIG. 6 illustrates an interpolation method using a sample-and-hold circuit with a low-pass filter, under an embodiment.

In the examples of FIGS. 4 and 5, the interpolation from a current to a desired rendering matrix state was performed by linear interpolation. In other embodiments, different interpolation schemes may also be used. One such alternative interpolation method uses a sample-and-hold circuit combined with a subsequent low-pass filter. FIG. 6 illustrates an interpolation method using a sample-and-hold circuit with a low-pass filter, under an embodiment. As shown in FIG. 6, the metadata instances m2 to m4 are converted to sample-and-hold rendering matrix coefficients. The sample-and-hold process causes the coefficient states to jump immediately to the desired state, which results in a step-wise curve 601, as shown. This curve is then subsequently low-pass filtered to obtain a smooth, interpolated curve 603. The interpolation filter parameters (e.g., cut-off frequency or time constant) can be signaled as part of the metadata, similarly to the case with linear interpolation. Different parameters may be used depending on the requirements of the system and the characteristics of the audio signal.

In an embodiment, the interpolation duration or ramp size can have any practical value, including a value of or substantially close to zero. Such a small interpolation duration is especially helpful for cases such as initialization in order to enable setting the rendering matrix immediately at the first sample of a file, or allowing for edits, splicing, or concatenation of streams. With this type of destructive edits, having the possibility to instantaneously change the rendering matrix can be beneficial to maintain the spatial properties of the content after editing.

In an embodiment, the interpolation scheme described herein is compatible with the removal of metadata instances, such as in a decimation scheme that reduces metadata bitrates. Removal of metadata instances allows the system to resample at a frame rate that is lower than an initial frame rate. In this case, metadata instances and their associated interpolation duration data that are added by an encoder may be removed based on certain characteristics. For example, an analysis component may analyze the audio signal to determine if there is a period of significant stasis of the signal, and in such a case remove certain metadata instances to reduce bandwidth requirements. The removal of metadata instances may also be performed in a separate component, such as a decoder or transcoder that is separate from the encoder. In this case, the transcoder removes metadata instances that are defined or added by the encoder. Such as system may be used in a data rate converter that re-samples an audio signal from a first rate to a second rate, where the second rate may or may not be an integer multiple of the first rate.

Figure 7:
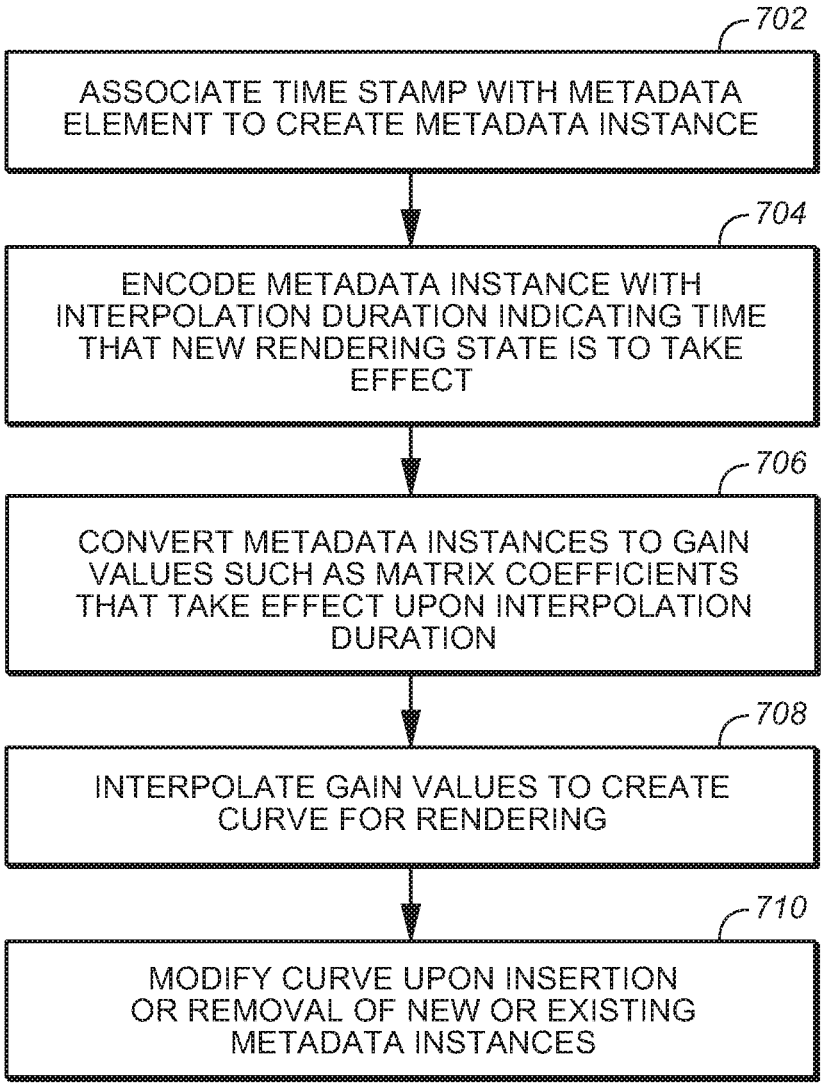
FIG. 7 is a flowchart that illustrates a method of representing spatial metadata that allows for lossless interpolation and/or re-sampling of the metadata, under an embodiment.

FIG. 7 is a flowchart that illustrates a method of representing spatial metadata that allows for lossless interpolation and/or re-sampling of the metadata, under an embodiment. Metadata elements generated by an authoring tool are associated with respective time stamps to create metadata instances (702). Each metadata instance represents a rendering state for playback of audio objects through a playback system. The process encodes each metadata instance with an interpolation duration that indicates the time that the new rendering state is to take effect relative to the time stamp of the respective metadata instance (704). The metadata instances are then converted to gain values, such as in the form of rendering matrix coefficients or spatial rendering vector values that are applied in the playback system upon the end of the interpolation duration (706). The gain values are interpolated to create a coefficient curve for rendering (708). The coefficient curve can be appropriately modified based on the insertion or removal of metadata instances (710).

Although in the previous examples, the time stamp indicates the start of the transition from a current rendering matrix coefficient to a desired rendering matrix coefficient, the described scheme will work equally well with a different definition of the time stamp, for example by specifying the point in time that the desired rendering matrix coefficient should have been reached.

Playback System

The adaptive audio system employing aspects of the metadata resampling process may comprise a playback system that is configured render and playback audio content that is generated through one or more capture, pre-processing, authoring and coding components. An adaptive audio pre-processor may include source separation and content type detection functionality that automatically generates appropriate metadata through analysis of input audio. For example, positional metadata may be derived from a multi-channel recording through an analysis of the relative levels of correlated input between channel pairs. Detection of content type, such as speech or music, may be achieved, for example, by feature extraction and classification. Certain authoring tools allow the authoring of audio programs by optimizing the input and codification of the sound engineer's creative intent allowing him to create the final audio mix once that is optimized for playback in practically any playback environment. This can be accomplished through the use of audio objects and positional data that is associated and encoded with the original audio content. In order to accurately place sounds around an auditorium, the sound engineer needs control over how the sound will ultimately be rendered based on the actual constraints and features of the playback environment. The adaptive audio system provides this control by allowing the sound engineer to change how the audio content is designed and mixed through the use of audio objects and positional data. Once the adaptive audio content has been authored and coded in the appropriate codec devices, it is decoded and rendered in the various components of the playback system.

In general, the playback system may be any professional or consumer audio system, which may include home theater (e.g., A/V receiver, soundbar, and Blu-ray), E-media (e.g., PC, Tablet, Mobile including headphone playback), broadcast (e.g., TV and set-top box), music, gaming, live sound, user generated content, and so on. The adaptive audio content provides enhanced immersion for the consumer audience for all end-point devices, expanded artistic control for audio content creators, improved content dependent (descriptive) metadata for improved rendering, expanded flexibility and scalability for consumer playback systems, timbre preservation and matching, and the opportunity for dynamic rendering of content based on user position and interaction. The system includes several components including new mixing tools for content creators, updated and new packaging and coding tools for distribution and playback, in-home dynamic mixing and rendering (appropriate for different consumer configurations), additional speaker locations and designs.

Embodiments are directed to a method of representing spatial rendering metadata that allows for lossless re-sampling of the metadata. The method comprises time stamping the metadata to create metadata instances, and encoding an interpolation duration with each metadata instance that specifies the time to reach a desired rendering state for the respective metadata instance. The re-sampling of metadata is generally important for re-clocking metadata to an audio coder and for the editing audio content. Such embodiments may be embodied as software, hardware, or firmware that includes implementation of aspects as either hardware or software. Embodiments further include non-transitory media that stores instructions capable of causing the software to be executed in a processing system to perform at least some of the aspects of the disclosed method.

Aspects of the audio environment described herein represents the playback of the audio or audio/visual content through appropriate speakers and playback devices, and may represent any environment in which a listener is experiencing playback of the captured content, such as a cinema, concert hall, outdoor theater, a home or room, listening booth, car, game console, headphone or headset system, public address (PA) system, or any other playback environment. The spatial audio content comprising object-based audio and channel-based audio may be used in conjunction with any related content (associated audio, video, graphic, etc.), or it may constitute standalone audio content. The playback environment may be any appropriate listening environment from headphones or near field monitors to small or large rooms, cars, open-air arenas, concert halls, and so on.

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method, performed by an audio signal processing device, for resampling a sequence of metadata instances representing time-varying rendering metadata in an object-based audio system, wherein each metadata instance:

specifies a desired rendering state;

is associated with a time stamp, the time stamp indicating a point in time to begin a transition from a current rendering state to the desired rendering state; and includes one or more parameters indicative of the time stamp and an interpolation duration parameter indicating the required time to reach the desired rendering state;

the method comprising:

receiving or generating the sequence of metadata instances;

generating one or more additional metadata instances; and inserting the one or more additional metadata instances between a first and a second metadata instance of the sequence of metadata instances to generate the resampled metadata sequence;

wherein the one or more additional metadata instances are substantially similar to the first metadata instance and/or the second metadata instance, with the exception of the interpolation duration parameter, which is different than the interpolation duration parameters of the first metadata instance and/or the second metadata instance; and wherein the desired rendering state is determined by converting the metadata instance into coefficients specifying gain factors for playback of audio content through audio drivers in a playback system.

2. The method of claim 1 wherein the desired rendering state represents one of: a spatial rendering vector or rendering matrix.

3. The method of claim 1 wherein the metadata describes spatial rendering data of one or more audio objects.

4. The method of claim 3 wherein the metadata describes how an object should be rendered through the audio drivers in the playback system.

5. The method of claim 1 wherein the time stamp represents the start of the transition from the current rendering state to the desired rendering state.

6. The method of claim 5 wherein the time stamp is defined relative to a reference point in the audio content processed by the object-based audio system.

7. The method of claim 1 further comprising:

determining if the current state does not significantly deviate from the desired state; and removing one or more metadata instances in between the current state and the desired state if the change does not significantly deviate.

8. The method of claim 1 further comprising converting each metadata instance into a set of values defining one of a spatial rendering vector or rendering matrix defining the desired rendering state.

9. The method of claim 1 wherein the metadata instances include metadata elements that define one or more object attributes selected from the group consisting of: object position, object size, and object zone exclusion.

10. An audio signal processing device for resampling a sequence of metadata instances representing time-varying rendering metadata in an object-based audio system, wherein each metadata instance:

specifies a desired rendering state;

is associated with a time stamp, the time stamp indicating a point in time to begin a transition from a current rendering state to the desired rendering state; and includes one or more parameters indicative of the time stamp and an interpolation duration parameter indicating the required time to reach the desired rendering state;

and wherein the audio signal processing device:

receives or generates the sequence of metadata instances;

generates one or more additional metadata instances; and inserts the one or more additional metadata instances between a first and a second metadata instance of the sequence of metadata instances to generate the resampled metadata sequence;

wherein the one or more additional metadata instances are substantially similar to the first metadata instance and/or the second metadata instance, with the exception of the interpolation duration parameter, which is different than the interpolation duration parameters of the first metadata instance and/or the second metadata instance; and wherein the desired rendering state is determined by converting the metadata instance into coefficients specifying gain factors for playback of audio content through audio drivers in a playback system.

11. The audio signal processing device of claim 10 wherein the desired rendering state represents one of: a spatial rendering vector or rendering matrix, and wherein the metadata describes spatial rendering data of one or more audio objects.

12. The audio signal processing device of claim 10 wherein the playback system is selected from a group consisting of: digital media disc player, home theater system, soundbar, personal music device, and cinema sound system.

13. The audio signal processing device of claim 12 wherein the metadata describes how an object should be rendered through the playback system, and wherein the metadata include one or more object attributes selected from the group consisting of: object position, object size, and object zone exclusion.

14. The audio signal processing device of claim 10, wherein the device further:

determines if a change between the current state does not significantly deviate from the desired state; and removes one or more metadata instances in between the current state and the desired state if the change does not significantly deviate.

15. A method, performed by an audio signal processing device, for generating a sequence of rendering states, comprising:

receiving a sequence of metadata instances representing time-varying rendering metadata of an object-based audio system, wherein:

each metadata instance is associated with a time stamp, the time stamp indicating a point in time to begin a transition from a current rendering state to a desired rendering state;

each metadata instance includes one or more parameters indicative of the time stamp and an interpolation duration parameter indicating the required time to reach the desired rendering state; and one or more consecutive metadata instances are substantially similar to a previous or subsequent metadata instance, with the exception of the interpolation duration parameter, which is different than the interpolation duration parameters of the previous or subsequent metadata instances;

converting each metadata instance into a respective desired rendering state comprising coefficients specifying gain factors for playback of audio content through audio drivers in a playback system; and determining the sequence of rendering states by interpolating, for each metadata instance, from the current rendering state to the respective desired rendering state, in response to the interpolation duration parameter.

16. An audio signal processing device for generating a sequence of rendering states, wherein the audio signal processing device:

receives a sequence of metadata instances representing time-varying rendering metadata of an object-based audio system, wherein:

each metadata instance is associated with a time stamp, the time stamp indicating a point in time to begin a transition from a current rendering state to a desired rendering state;

each metadata instance includes one or more parameters indicative of the time stamp and an interpolation duration parameter indicating the required time to reach the desired rendering state; and one or more consecutive metadata instances are substantially similar to a previous or subsequent metadata instance, with the exception of the interpolation duration parameter, which is different than the interpolation duration parameters of the previous or subsequent metadata instances;

converts each metadata instance into a respective desired rendering state comprising coefficients specifying gain factors for playback of audio content through audio drivers in a playback system; and determines the sequence of rendering states by interpolating, for each metadata instance, from the current rendering state to the respective desired rendering state, in response to the interpolation duration parameter.

* * * * *